US006900166B2

(12) United States Patent
Evers et al.

(10) Patent No.: US 6,900,166 B2
(45) Date of Patent: May 31, 2005

(54) DRY CLEANING PROCESS COMPRISING A DRY CLEANING STEP AND A REGENERATION STEP

(75) Inventors: Joop Evers, Vlaardingen (NL); Machiel Goedhart, Vlaardingen (NL); Fred Kerpels, Vlaardingen (NL); Cornelis Gerhard Kralingen van, Vlaardingen (NL); Pieter Everhardus Overdevest, Vlaardingen (NL); Hank Robert Reinhoudt, Vlaardingen (NL); Karin Vrieswijk, Vlaardingen (NL)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 331 days.

(21) Appl. No.: 10/278,308

(22) Filed: Oct. 23, 2002

(65) Prior Publication Data

US 2003/0087782 A1 May 8, 2003

(30) Foreign Application Priority Data

Oct. 26, 2001 (EP) ..... 01204114

(51) Int. Cl.[7] ..... C11D 3/44

(52) U.S. Cl. ..... 510/285; 510/276; 510/284; 510/304; 510/338; 510/371; 134/10; 134/11; 134/12; 134/95.1; 8/142

(58) Field of Search ..... 510/285, 276, 510/284, 304, 338, 371; 134/10, 11, 12, 95.1

(56) References Cited

U.S. PATENT DOCUMENTS 5,112,358 A * 5/1992 Deal, III ..... 8/137
6,039,766 A 3/2000 Mizuno et al.
6,127,430 A * 10/2000 Baran et al. ..... 516/24
6,159,917 A * 12/2000 Baran et al. ..... 510/291
6,200,943 B1 * 3/2001 Romack et al. ..... 510/285

FOREIGN PATENT DOCUMENTS

| | | |
|---|---|---|
| EP | 1048777 A1 | 2/2000 |
| WO | 97/22683 | 6/1997 |
| WO | 00/36206 | 6/2000 |

OTHER PUBLICATIONS

European Search Report Application No. EP 01 20 4114 completed Mar. 27, 2002.

Derwent Publication XP 002142988 & JP 08 113869 A (Jul. 1996) assigned to Daiichi Kogyo Seiyaku Co.

Patent Abstracts of Japan, vol. 1997, No. 09, (Sep. 1997) & JP 09 137376 A assigned to Mitsubishi Heavy Ind. Ltd.

* cited by examiner

*Primary Examiner*—Charles Boyer
(74) *Attorney, Agent, or Firm*—Ronald A. Koatz

(57) ABSTRACT

A process for dry cleaning laundry articles comprising at least one dry cleaning step followed by at least one regeneration step wherein said regeneration step comprises contacting the articles with a regeneration composition comprising 0 to 10 wt. % of a surfactant;

0.001 to 10 wt. % of water;

0 to 50 wt. % of a cosolvent and the balance being organic dry cleaning solvent, preferably a non-flammable, non-chlorine containing organic dry cleaning solvent, wherein the regeneration composition comprises an aqueous phase having a pH of at least 5.

20 Claims, No Drawings

DRY CLEANING PROCESS COMPRISING A DRY CLEANING STEP AND A REGENERATION STEP

The present invention relates to a dry cleaning process, in particular for cleaning articles like laundry articles and a dry cleaning composition for use in said process.

In dry cleaning the laundry articles are usually immersed in or washed with solvent liquids. Applications involving one or more stages of immersion, rinsing and/or drying are known. Solvents can be used at ambient temperature or at elevated temperatures up to the boiling point of the solvent.

Traditionally, dry cleaning is predominantly performed by small private enterprises and the cleaning performance of the dry cleaning compositions per se is often poor. In practice, reasonable cleaning can only be achieved by extensively pretreating the garments which is rather time consuming and inefficient. For example, particulate soil is a common type of stain that is difficult to clean using dry cleaning only without extensive manual pretreatment.

The solvents used in traditional dry cleaning are chlorinated solvents such as chlorocarbons such as perchloroethylene and chlorofluorocarbons such as 1,1,2,-trichloro-1,2,2-trifluoroethane either alone or in admixture with one or more cosolvents such as aliphatic alcohols or other low molecular weight, polar compounds. The conventional dry cleaning process often employs perchloroethylene (perc) as the main dry cleaning solvent. One of the major advantages of perchloroethylene is that the solvent itself shows an effective cleaning performance on oily stains. Accordingly, the conventional dry cleaning compositions processes are adapted to this cleaning effect.

However, since many of these organic solvents pose environmental problems such as ozone depletion their use is heavily debated. Liquid carbon dioxide has also been suggested as an alternative solvent. The most important drawback of this inorganic solvent however, is that expensive high pressure equipment is needed to perform dry cleaning in liquid carbon dioxide. A novel and more promising class of dry cleaning solvents are the so called non-flammable, non-chlorine containing organic solvents. Examples include siloxanes, and fluorinated solvents like hydrofluoroethers such as nonafluoromethoxybutane and nonafluoroethoxybutane or hydrofluorocarbons as decafluoropentane. These novel solvents have been claimed to be non-ozone depleting and to have far smaller coefficients of global warming.

WO 00/36206 discloses a dry cleaning composition comprising hydrofluoroether, 1–30 wt. % of a nonionic fluorosurfactant and less than 1 wt. % water. JP 11140499 discloses a dry cleaning composition comprising hydrofluoroether, 0 percent water and 10 and up to 90 wt. % of salt of a fluoralkyl phosphate surfactant. U.S. Pat. No. 6,127,430 discloses a composition comprising from 0.1 to 99 parts by weight of hydrofluoroether and from 99.9 to 1 parts by weight of water, the sum of a and b equalling 100 parts, and certain fluorinated surfactants. WO 97/22683 (3M) discloses a dry cleaning composition comprising hydrofluoroether and 0.1 wt. % of a nonionic surfactant like fluoralkyl sulphon amide. U.S. Pat. No. 5,610,128 discloses compositions with perfluoroalkylamine salts of octylphenyl acid phosphate.

However, this new class of non-flammable, non-chlorine containing organic dry cleaning solvents has one major drawback. While having less environmental drawbacks dry cleaning with these new solvents still show an inadequate cleaning performance. These solvents are typically poor solvents and show little or no cleaning activity on stained and soiled laundry. For example, common stains are notoriously difficult to remove with fluorinated solvents. A desirable dry cleaning composition should not only clean all kinds of stains satisfactorily but also provide optimal garment care. For example, a reduction in wrinkles would decrease the need for ironing. With respect to garment care especially colour care is a notorious problem since many dyes are vulnerable to dry cleaning compositions. Dry cleaning is not suitable for many clothes simply because the dye is not compatible with the dry cleaning composition. On the other hand, certain compositions needed to clean tougher stains may have adverse effects on garment care such as colour care. Therefore, there is a need for novel dry cleaning processes and compositions that deliver effective cleaning and/or garment care even with this new class of dry cleaning solvents.

According to a first aspect of the invention an improved process for dry cleaning laundry is provided comprising at least one dry cleaning step followed by at least one regeneration step wherein said regeneration step comprises contacting the articles with a regeneration composition comprising 0 to 10 wt. % of a surfactant;

0.001 to 10 wt. of water;

0 to 50 wt. % of a cosolvent and the balance being organic dry cleaning solvent, preferably a non-flammable, non-chlorine containing organic dry cleaning solvent, wherein the regeneration composition comprises an aqueous phase having a pH of at least 5.

The inventive process according to this aspect of the invention shows surprisingly good garment care, colour care and/or effective cleaning for a variety of stains. One of the unexpected advantages is that now a wider variety of dry cleaning compositions can be used because the inventive process minimises adverse effects on garment care.

These and other aspects, features and advantages will become apparent to those of ordinary skill in the art from a reading of the following detailed description and the appended claims. For the avoidance of doubt, any feature of one aspect of the present invention may be utilised in any other aspect of the invention. It is noted that the examples given in the description below are intended to clarify the invention and are not intended to limit the invention to those examples per se. Other than in the experimental examples, or where otherwise indicated, all numbers expressing quantities of ingredients or reaction conditions used herein are to be understood as modified in all instances by the term "about". Similarly, all percentages are weight/weight percentages of the total composition unless otherwise indicated. Numerical ranges expressed in the format "from x to y" are understood to include x and y. When for a specific feature multiple preferred ranges are described in the format "from x to y", it is understood that all ranges combining the different endpoint are also contemplated. Where the term "comprising" is used in the specification or claims, it is not intended to exclude any terms, steps or features not specifically recited. All temperatures are in degrees Celsius (° C.) unless otherwise specified. All measurements are in SI units unless otherwise specified. All documents cited are in relevant part, incorporated herein by reference.

DETAILED DESCRIPTION OF THE INVENTION

Definitions

The term "dry cleaning process" used herein is intended to mean any process wherein laundry articles are contacted with a dry cleaning composition within a closable vessel wherein the dry cleaning composition is substantially non-aqueous, i.e., it preferably comprises at least 50 wt. %, more preferably at least 80 wt. %, even more preferably at least 85 wt. % of a dry cleaning solvent. This term is used interchangeably with the term "a process for dry cleaning laundry articles". However, as used herein this term does not include any process wherein the fabric articles are also immersed and rinsed in an aqueous cleaning composition of more than 80 wt % water. This would defy the purpose of the dry cleaning.

The term "dry cleaning composition" as used herein is intended to mean the composition used in the dry cleaning process including the dry cleaning solvent, any surfactant, cleaning and/or care agents but excluding the fabric articles that are to be cleaned. To avoid any doubt, this term encompasses the non-aqueous as well as the low aqueous dry cleaning composition.

The term "organic dry cleaning solvent" as used herein is intended to mean any non-aqueous solvent that preferably has a liquid phase at 20° C. and standard pressure. The term organic has its usual meaning, i.e., a compound with at least one carbon hydrogen bond. When the amount of the dry cleaning solvent is described as "the balance" it is not intended to exclude other (optional) ingredients that may be used. It is simply meant to describe that the main body of the dry cleaning composition is dry cleaning solvent, i.e., the dry cleaning solvent comprises more than 50 wt % of the dry cleaning composition by weight of the dry cleaning composition.

The term "immerse" as used herein is intended to mean that the fabric article is contacted with a sufficient amount of dry cleaning composition to wet the whole fabric article. The water content refers to water purposefully added to the laundry articles, for example as part of the dry cleaning composition as such or a pretreatment composition including hydrated water as part of other (cleaning or care) ingredients making up these compositions. It is not intended to include the moisture of the untreated wash load e.g., a wet towel.

Process of Dry Cleaning

Generally, articles such as clothing are cleaned by contacting a sufficient amount of the dry cleaning composition according to one aspect of the invention with the articles for a sufficient period of time to clean the articles or otherwise remove stains. The amount of dry cleaning composition used and the amount of time the composition contacts the article can vary based on equipment and the number of articles being cleaned. Normally, the process of dry cleaning will comprise at least the step of contacting the article with low aqueous dry cleaning composition according the second aspect of the invention and at least one step of rinsing the article with a fresh load of solvent. The rinse composition will usually comprise of mainly solvent but garment care or cleaning agents may be added as desired. The liquid to cloth ratio (w/w) is usually greater than 1 therefore the laundry will normally be immersed at least partly and sometimes even totally in the dry cleaning composition during the dry cleaning process.

According to the first aspect of the invention, it was found that effective garment care could be provided by including a regeneration step in the dry cleaning process. Thus, according this aspect of the present invention, one preferred process of dry cleaning comprises at least one regeneration step wherein said regeneration step comprises contacting the articles with a regeneration composition comprising 0 to 10 wt. % of a surfactant;

0.001 to 10 wt. of water;

0 to 50 wt. % of a cosolvent and the balance being organic dry cleaning solvent, preferably a non-flammable, non-chlorine containing organic dry cleaning solvent, wherein the regeneration composition comprises an aqueous phase having a pH of at least 5.

The desired pH in the aqueous phase can be achieved in manners known in the art such as using a sufficient amount of an inorganic or organic base and/or acid. The amount of base and/or acid will usually depend on the ratio of aqueous phase to non-aqueous phase, the number and nature of the articles and the pH of the aqueous phase of the primary low aqueous dry cleaning composition, but can be determined by the skilled person. In general, the regeneration composition will comprise 0 to 80 wt. %, preferably 0.001 to 70 wt. % of an inorganic or organic base and/or acid, more preferably 0.01 to 50 wt. % or even more preferably 0.1 to 40 wt. % by weight of the aqueous phase. The pH is preferably at least 7, more preferably at least 8, or most preferably at least 8.5. Preferably, a suitable organic or inorganic buffer is used to maintain the appropriate pH.

Suitable bases and/or acids are selected from bases and/or acids that are compatible with the organic dry cleaning composition and show no adverse effects to the articles to be cleaned. Organic and inorganic bases and/or acids are for example listed in the CRC Handbook of Chemistry and Physics, 81$^{st}$ ed, p 8–44 to 8–56. Preferred bases and/or acids include compounds comprising at least one hydroxide, amine, carboxylate, carbonate, citrate, borate, sulphate, phosphate group and mixtures thereof. Preferred compounds are for example, soda ash, KOH, NaOH, HCl.

The water content of the regeneration composition will generally be from 0.01 to 5 wt. % or preferably from 0.05 to 3 wt. % or most preferably from 0.1 to 1 wt. % by weight of the total dry cleaning composition.

The amount of surfactant in the regeneration composition may be from at least 0.001 wt. % up to and including 10 wt. % by weight of the dry cleaning composition. More preferably, the surfactant is present from 0.01 up to and including 3 wt. % or even more preferably from 0.05 up to and including 0.9 wt. % by weight of the dry cleaning composition. However, in some cases no surfactant may be present at all.

Prior to the regeneration step the articles may be contacted one or more times with one or more dry cleaning compositions. This may be any dry cleaning composition known in the art. A preferably dry cleaning composition comprises an effective amount of surfactant;

0 to 50 wt. % of a cosolvent and the balance being an organic dry cleaning solvent, preferably a non-flammable, non-chlorine containing organic dry cleaning solvent. The dry cleaning compositions may be non-aqueous or low-aqueous.

Thus, the dry cleaning process may comprise at least one non-aqueous dry cleaning step prior to the regeneration step, wherein said articles are contacted with a non-aqueous dry cleaning composition said non-aqueous dry cleaning composition comprising 0.001 to 10 wt. % of a surfactant;

0 to 0.01 wt. % of water;

0 to 50 wt. % of a cosolvent and the balance being an organic dry cleaning solvent, preferably a non-flammable, non-chlorine containing organic dry cleaning solvent;

Alternatively, the dry cleaning process may comprise at least one low aqueous dry cleaning step prior to the regeneration step, wherein said articles are contacted with a low aqueous dry cleaning composition said low aqueous dry cleaning composition comprising 0.001 to 70 wt. % of a surfactant;

0.01 to 10 wt. % of water;

0 to 50 wt. % of a cosolvent and the balance being an organic dry cleaning solvent, preferably a non-flammable, non-chlorine containing organic dry cleaning solvent.

Usually at least one rinsing step will be included, wherein the articles are contacted with a rinse composition said rinse composition comprising 0 to 0.0001 wt. % of a surfactant;

0 to 10 wt. % of water;

0 to 50 wt. % of a cosolvent and the balance being an organic dry cleaning solvent, preferably a non-flammable, non-chlorine containing organic dry cleaning solvent.

The regeneration step may precede but will often follow or replace the rinsing step. Preferably, if the dry cleaning process involves any additional step after the regeneration step, these additional steps will have a pH of 5 or higher.

Depending on the desired cleaning, the low aqueous and non-aqueous compositions may be used in any order. However, in many cases it will be preferred to contact the articles with a non-aqueous composition prior to a low aqueous dry cleaning composition.

An especially suitable process for dry cleaning laundry comprises contacting articles with the non-aqueous composition, then low aqueous composition and followed by the regeneration composition. This process delivers excellent cleaning of a variety of stains while providing optimal garment and colour care.

The dry cleaning process may comprise different steps in any order depending on the desired outcome. The number and length of steps for e.g., cleaning, rinsing, conditioning steps may depend on the desired outcome. Each step may preferably last from at least 0.1 min, or preferably at least 0.5 min or more preferably at least 1 min or even 5 min, and at most 2 hrs, preferably at most 30 min, even more preferably at most 20 min and in some instances at most 5 min. In some cases longer times may be desired for example overnight.

Generally, the laundry articles in need of treatment will be placed inside a closable vessel. It will be clear that the process is also suitable for cleaning one laundry article at the time although it will often be more efficient to clean more articles at the same time. Preferably, the vessel is a rotatable drum as part of an automated dry cleaning machine that is closed or sealed in such a way that the dry cleaning solvent can be contained within the machine if needed. Inside the vessel, the laundry articles are then contacted with the dry cleaning composition. This may be done in any way known in the art such as spraying or even using mist.

In some cases it may be useful to formulate the dry cleaning composition in situ in the drum by contacting the different ingredients of the dry cleaning composition separately with the laundry articles. For example—when the dry cleaning composition comprises dry cleaning solvent, water and surfactant—first water, then surfactant followed by the dry cleaning solvent. Or first the dry cleaning solvent, followed by the surfactant and then water. Or any other order.

Alternatively, 2 or more of the ingredients may be premixed before they are contacted with the laundry articles. For example, water and surfactant may be premixed and this premix is then contacted with the laundry followed by the dry cleaning solvent. In the alternate, dry cleaning solvent and surfactant may be premixed and this premix is then contacted with the laundry followed by water.

Thus, in one preferred aspect, in situ formulation of the dry cleaning composition may also be provided by incorporating one or more ingredients of the dry cleaning composition into a pretreatment composition, pretreating the laundry articles with the pretreatment composition, contacting the laundry articles with the remaining ingredients of the dry cleaning composition thereby formulating the dry cleaning composition in situ. This pretreatment may take place manually outside the drum or mechanically inside the drum as part of a pretreatment step.

The pretreatment step per se need not be immersive, i.e., it may be limited to treating the stained areas only provided that when the laundry articles are contacted all the ingredients making up the final dry cleaning composition, the laundry articles are immersed in said dry cleaning composition. For example—when the dry cleaning composition comprises of dry cleaning solvent, water and surfactant—stained areas of the laundry articles may be pre-treated with a premix of water and surfactant manually or by an automated process. After sufficient pretreatment time is allowed, the laundry articles may be contacted in the drum with the remaining ingredients such as in this case, the dry cleaning solvent (and optionally the remaining amounts of water, surfactant and cleaning agent) to result in situ in the dry cleaning composition according to this aspect of the invention. The pretreatment time will be at least 5 sec but could be less than 1 day, preferably less than 1 hr, more preferably less than 30 min. The pretreatment composition may be formulated to treat specific stains. For example sufficient amounts of protease and other enzymes may be included to treat proteinacious stains.

In another preferred embodiment, the complete dry cleaning composition is premixed in a separate premix compartment. For example, when the dry cleaning composition comprises dry cleaning solvent, surfactant and water, these may be premixed in a separate compartment before the dry cleaning composition is contacted with the laundry article. Preferably such a premix is in the form of an emulsion or microemulsion. Forming a premix of for example a water-in-oil emulsion can be brought about by any number of suitable procedures. For example, the aqueous phase containing an effective amount of surfactant package can be contacted with the solvent phase by metered injection just prior to a suitable mixing device.

Metering is preferably maintained such that the desired solvent/water ratio remains relatively constant. Mixing devices such as pump assemblies or in-line static mixers, a centrifugal pump or other type of pump, a colloid mill or other type of mill, a rotary mixer, an ultrasonic mixer and other means of dispersing one liquid in another, non-miscible liquid can be used to provide sufficient agitation to cause emulsification.

These static mixers are devices through which the emulsion is passed at high speed and in which said emulsion experiences sudden changes in direction and/or in the diameter of the channels which make up the interior of the mixers. This results in a pressure loss, which is a factor in obtaining a correct emulsion in terms of droplet size and stability.

In one variant of the method of the invention, the mixing steps are for example sequential. The procedure consists of mixing the solvent and emulsifier in a first stage, the premix being mixed and emulsified with the water in a second stage.

In another variant of the method of the invention, provision is made for carrying out the above steps in a continuous mode.

The premix may take place at room temperature, which is also the temperature of the fluids and raw materials used.

A batch process such as an overhead mixer or a continuous process such as a two fluid co-extrusion nozzle, an in-line injector, an in-line mixer or an in-line screen can be used to make the emulsion. The size of the emulsion composition in the final composition can be manipulated by changing the mixing speed, mixing time, the mixing device and the viscosity of the aqueous solution. In general, by reducing the mixing speed, decreasing the mixing time, lowering the viscosity of the aqueous solution or using a mixing device that produces less shear force during mixing, one can produce an emulsion of a larger droplet size. Especially preferred are ultrasonic mixers. Although the description above refers to the addition of surfactant it is understood it may also apply to the addition of cleaning agents.

While the laundry articles are in contact with the dry cleaning solvent, it is preferred to add mechanical energy for example by agitating or tumbling the laundry articles by rotating the drum or other means known in the art. Usually after one step, the dry cleaning solvent including any cleaning agents and/or loosened soil will be separated from the laundry articles. This is preferably done by spinning the laundry articles and collecting the dry cleaning composition, although other separation methods known in the art may also be employed such as evaporation. The dry cleaning solvent is then preferably recycled by separating the soil and/or cleaning agents from the solvent.

In other instances it may be advantageous to recirculate at least part of the dry cleaning composition during one step. For example by separating a portion of the dry cleaning composition from the laundry articles, optionally filtering soil from the separated portion of dry cleaning composition and contacting the laundry articles with the filtered portion of the dry cleaning composition.

The dry cleaning is usually performed at atmospheric pressure and ambient temperature, between 10 and 30° C. in most countries. In some instances the process temperature may be elevated to just under the boiling point of the most volatile dry cleaning solvent used. Sometimes the process may be performed under reduced or elevated pressure, typically achieved via a vacuum pump or by supplying a gas, such as nitrogen, to the apparatus thereby increasing the pressure the closable vessel. The process of dry cleaning may be carried out in any suitable apparatus. Preferably, the apparatus will comprise of a closable vessel and means to recycle the dry cleaning solvents used to minimise solvent losses into the environment. The dry cleaning composition may be in the form of a micro-emulsion but usually will be in the form of a macro-emulsion, which is generally accepted to be thermodynamically unstable. A suitable process and appliance for dry cleaning is described in U.S. Pat. No. 6,045,588. The solvent will preferably be filtered and recycled in the same appliance. Generally, the laundry articles will be agitated in the dry cleaning process by tumbling, rotating, ultrasonics or any suitable type of mechanical energy (see U.S. Pat. No. 6,045,588).

Still other advantages and novel features of the present invention will become apparent to those skilled in the art from the following detailed description, which presents, by way of illustration, various exemplary modes contemplated for carrying out the invention. As will be realised, the invention is capable of other different aspects and objects all without departing from the invention. Accordingly, advantages, aspects, and descriptions are illustrative in nature and not restrictive.

The surfactants, dry cleaning solvents, cosolvents and optional cleaning agents used in present invention are described below and may be the same or different for each step of the inventive process. Usually the primary dry cleaning solvent will be the same.

Dry Cleaning Solvent

The dry cleaning solvent can be any dry cleaning solvent known in the art but is usually a non-flammable, non-chlorine containing organic dry cleaning solvent. Although the term dry cleaning solvent is used in the singular, it should be noted that a mixture of solvents may also be used. Thus, the singular should be taken to encompass the plural, and vice versa. When mixtures of solvents are used, the solvent that is most abundant may be denoted as the primary or main solvent. Because of the typical environmental problems associated with chlorine containing solvents, the solvent preferably does not contain Cl atoms. In addition, the solvent should not be flammable such as petroleum or mineral spirits having typical flash points as low as 20° C. or even lower. The term non-flammable is intended to describe organic dry cleaning solvents with a flash point of at least 37.8° C., more preferably at least 45° C., most preferably at least 50° C. The limit of a flashpoint of at least 37.8° C. for non-flammable liquids is defined in NFPA 30, the Flammable and Combustible Liquids Code as issued by National Fire Protection Association, 1996 edition, Massachusetts USA. Preferred test methods for determining the flash point of solvents are the standard tests as described in NFPA30. One preferable class of solvents is a fluorinated organic dry cleaning solvent including hydrofluorocarbon (HFC), hydrofluoroether (HFE) or mixtures thereof. However even more preferred are non-halogenated solvents. For example other classes of suitable highly preferred solvents are non-flammable siloxanes and hydrocarbons (see below). (see below).

The most desirable solvents are non-ozone depleting and a useful common definition for the ozone depleting potential is defined by the Environmental Protection Agency in the USA: the ozone depleting potential is the ratio of the impact on ozone of a chemical compared to the impact of a similar mass of CFC-11. Thus, the ODP of CFC-11 is defined to be 1.0.

Hydrofluorocarbons

One preferred hydrofluorocarbon solvent is represented by the formula $C_xH_yF_{(2x+2-y)}$, wherein x is from 3 to 8, y is from 1 to 6, the mole ratio of F/H in the hydrofluorocarbon solvent is greater than 1.6.

Preferably, x is from 4 to 6 and most preferred x is 5 and y is 2.

Especially suitable are hydrofluorocarbon solvents are selected from isomers of decafluoropentane and mixtures thereof. In particular useful is 1,1,1,2,2,3,4,5,5,5-decafluoropentane. The E.I. Du Pont De Nemours and Company markets this compound under the name Vertrel XF™.

Hydrofluoroethers

Hydrofluoroethers (HFEs) suitable for use in the present invention are generally low polarity chemical compounds minimally containing carbon, fluorine, hydrogen, and catenary (that is, in-chain) oxygen atoms. HFEs can optionally contain additional catenary heteroatoms, such as nitrogen and sulphur. HFEs have molecular structures which can be linear, branched, or cyclic, or a combination thereof (such as alkylcycloaliphatic), and are preferably free of ethylenic unsaturation, having a total of about 4 to about 20 carbon atoms. Such HFEs are known and are readily available, either as essentially pure compounds or as mixtures.

HFEs can be relatively low in toxicity, are claimed to have zero ozone depletion potential, can have short atmospheric lifetimes and low global warming potentials relative to chlorofluorocarbons and many chlorofluorocarbon substitutes. Furthermore, HFEs are listed as non volatile organic compounds by the EPA. Volatile organic compounds are considered to be smog precursors.

Preferred hydrofluoroethers can have a boiling point in the range from about 40° C. to about 275° C., preferably from about 50° C. to about 200° C., even more preferably from about 50° C. to about 121° C. It is very desirable that the hydrofluoroether has no flashpoint. In general, when a HFE has a flash point, decreasing the F/H ratio or decreasing the number of carbon-carbon bonds each decreases the flash point of the HFE (see WO/00 26206).

Useful hydrofluoroethers include two varieties: segregated hydrofluoroethers and omega-hydrofluoroalkylethers. Structurally, the segregated hydrofluoroethers comprise at least one mono-, di-, or trialkoxy-substituted perfluoroalkane, perfluorocycloalkane, perfluorocycloalkyl-containing perfluoroalkane, or perfluorocycloalkylene-containing perfluoroalkane compound.

HFEs suitable for use in the processes of the invention include the following compounds:

$C_4F_9OC_2F_4H$
$HC_3F_6OC_3F_6H$
$HC_3F_6OCH_3$
$C_5F_{11}OC_2F_4H$
$C_6F_{13}OCF_2H$
$C_6F_{13}OC_2F_4OC_2F_4H$
c—$C_6F_{11}CF_2OCF_2H$
$C_3F_7OCH_2F$
$HCF_2O\ (C_2F_4O)_n(CF_2O)_mCF_2H$, wherein m=0 to 2 and n=0 to 3
$C_3F_7O[C(CF_3)_2CF_2O]_pCFHCF_3$, wherein p=0 to 5
$C_4F_9OCF_2C\ (CF_3)_2CF_2H$
$HCF_2CF_2OCF_2C\ (CF_3)_2CF_2OC_2F_4H$
$C_7F_{15}OCFHCF_3$
$C_8F_{17}OCF_2O\ (CF_2)_5H$
$C_8F_{17}OC_2F_4OC_2F_4OC_2F_4OCF_2H$
$C_4F_9OC_2H_5$
$C_4F_9OCH_3$
$C_8F_{17}OCH_3$ Preferred HFEs are according to the formula $$C_nX_{2n+1}—O—C_mY_{2m+1}$$

Wherein X and Y are independently F or H provided that at least one F is present. Preferably, X=F and Y=H; n=2–15 and m=1–10, but preferably, n=3–8 and m=1–4, or more preferably n=4–6 and m=1–3.

Especially preferred is a HFE wherein n=4 and m=1 or 2 which is marketed under the name of HFE 7100™ and 7200™ respectively by the 3M corporation.

Mixtures of different organic dry cleaning solvents may also be used. For example, a suitable dry cleaning composition may comprise a mixture of HFEs together with a mixture of hydrocarbons and/or siloxanes.

When solvent compounds are mentioned, isomers thereof are also included. Thus, suitable HFEs include nonafluoromethoxybutane (C4F9OCH3) isomers such as 1,1,1,2,2,3,3,4,4-nonafluoro-4-methoxy-butane (CH3OCF2CF2CF2CF3), 1,1,1,2,3,3-hexafluoro-2-(trifluoromethyl)-3-methoxy-propane (CH3OCF2CF(CF3)2), 1,1,1,3,3,3-hexafluoro-2-methoxy-$^2$-(trifluoromethyl)-propane (CH3OC(CF3)3), and 1,1,1,2,3,3,4,4,4-nonafluoro-2-methoxy-butane (CH3OCF(CF3)CF2CF3), approximate isomer boiling point=60° C.; Also isomers of nonafluoroethoxybutane (C4F9OC2H5) such as 1,1,1,2,2,3,3,4,4-nonafluoro-4-ethoxybutane (CH3CH2OCF2CF2CF2CF3), 1,1,1,2,3,3-hexafluoro-2-(trifluoromethyl)-3-ethoxypropane (CH3CH2OCF2CF(CF3)2), 1,1,1,3,3,3 -hexafluoro-2-ethoxy-2-(trifluoromethyl)-propane (CH3CH2OC(CF3)3), and 1,1,1,2,3,3,4,4,4-nonafluoro-2-ethoxybutane (CH3CH2OCF(CF3)CF2CF3) with approximate isomer boiling points of 73° C.

Especially suitable organic dry cleaning solvents are selected from the group consisting of the isomers of nonafluoromethoxybutane, nonafluoroethoxybutane and decafluoropentane and mixtures thereof.

The dry cleaning compositions of the invention generally contain greater than about 50 percent by weight organic dry cleaning solvent, preferably greater than about 75 weight percent, and more preferably greater than about 85 weight percent of organic dry cleaning solvent. Such amounts aid in improved dry times and maintain a high flashpoint or no flashpoint at all.

Water

The amount of water in the dry cleaning composition is important. The amount of water present in the low aqueous dry cleaning composition is preferably from 0.01 to 50 wt. % water more preferably from 0.01 to 10 wt. % or even more preferably from 0.01 to 0.9 wt. % water by weight of the dry cleaning composition or more preferably, 0.05 to 0.8 wt. % or most preferable 0.1 to 0.7 wt. %. The amount of water present in the non-aqueous dry cleaning composition is preferably from 0 to 0.1 wt. % water by weight of the dry cleaning composition or more preferably, 0 to 0.01 wt. % or even more preferable 0 to 0.001 wt. % and most preferable 0 wt. %.

Cosolvents

The compositions of the invention may contain one or more cosolvents. The purpose of a cosolvent in the dry cleaning compositions of the invention is to increase the solvency of the dry cleaning composition for a variety of soils. The cosolvent also enables the formation of a homogeneous solution containing a cosolvent, a dry cleaning solvent, and the soil; or a cosolvent, a dry cleaning solvent and an optional detergent. As used herein, a "homogeneous composition" is a single phased composition or a composition that appears to have only a single phase, for example, a macro-emulsion, a micro-emulsion or an azeotrope. However, if a cosolvent is used the dry cleaning composition is preferably a non-azeotrope as azeotropes may be less robust.

Useful cosolvents of the invention are soluble in the dry cleaning solvent or water, are compatible with typical detergents, and can solubilise aqueous-based stains and oils typically found in stains on clothing, such as vegetable, mineral, or animal oils. Any cosolvent or mixtures of cosolvents meeting the above criteria may be used.

Useful cosolvents include alcohols, ethers, glycol ethers, alkanes, alkenes, linear and cyclic amides, perfluorinated tertiary amines, perfluoroethers, cycloalkanes, esters, ketones, aromatics, siloxanes, the fully or partly halogenated derivatives thereof and mixtures thereof. Preferably, the cosolvent is selected from the group consisting of alcohols, alkanes, alkenes, cycloalkanes, ethers, esters, cyclic amides, aromatics, ketones, siloxanes, the fully or partly halogenated derivatives thereof and mixtures thereof.

In particular, hydrocarbons are preferably selected from the group consisting of linear and branched aliphatic hydrocarbons with from 8 to 20 carbon atoms or more preferably, 10 to 16 carbon atoms.

Representative examples of cosolvents which can be used in the dry cleaning compositions of the invention include methanol, ethanol, isopropanol, t-butyl alcohol, trifluoroethanol, pentafluoropropanol, hexafluoro-2-propanol, methyl t-butyl ether, methyl t-amyl ether, propylene glycol n-propyl ether, propylene glycol n-butyl ether, dipropylene glycol n-butyl ether, propylene glycol methyl ether, ethylene glycol monobutyl ether, 1,2-dimethoxyethane, cyclohexane, 2,2,4-trimethylpentane, n-decane, terpenes (for example, a-pinene, camphene, and limonene), trans-1,2-dichloroethylene, methylcyclopentane, decalin, methyl decanoate, t-butyl acetate, ethyl acetate, glycol methyl ether acetate, ethyl lactate, diethyl phthalate, 2-butanone, N-alkyl pyrrolidone (such as N-methyl pyrrolidone, N-ethyl pyrrolidone), methyl isobutyl ketone, naphthalene, toluene, trifluorotoluene, hexamethyl disiloxane, octamethyl trisiloxane, decamethyl tetrasiloxane, perfluorohexane, perfluoroheptane, perfluorooctane, perfluorotributylamine, perfluoro-2-butyl oxacyclopentane.

One especially preferred cosolvent is a siloxane which may be linear, branched, or cyclic, or a combination thereof. Of these linear and cyclic oligo dimethylsiloxanes are preferred. Also preferred is an alkylsiloxane represented by the formula $$R_3—Si(—O—SiR_2)_w—R$$

Where each R is independently chosen from an alkyl group having form 1 to 10 carbon atoms and w is an integer from 1 to 30. Preferably, R is methyl and w is 1–4 or even more preferably w is 3 or 4.

Of the cyclic siloxane octamethyl cyclotetrasiloxane and decamethyl cyclopentasiloxane are particularly effective.

Very useful siloxanes are selected from the group consisting of hexamethyldisiloxane, octamethyltrisiloxane decamethyltetrasiloxane, dodecamethylpentasiloxane and mixtures thereof. It should be noted that siloxanes can also be used as the main dry cleaning solvent, as mentioned above.

The cosolvent is present in the compositions of the invention in an effective amount by weight to form a homogeneous composition with the other dry cleaning solvent(s) such as HFE. The effective amount of cosolvent will vary depending upon which cosolvent or cosolvent blends are used and the other dry cleaning solvent(s) used in the composition. However, the preferred maximum amount of any particular cosolvent present in a dry cleaning composition should not be above the amount needed to make the composition inflammable.

In general, cosolvent may be present in the compositions of the invention in an amount of from about 1 to 50 percent by weight, preferably from about 3 to about 25 percent by weight, and more preferably from about 5 to about 15 percent by weight.

Surfactants

The dry cleaning compositions of the invention can utilise many types of cyclic, linear or branched surfactants known in the art, both fluorinated and non-fluorinated. Preferred solvent compatible surfactants include nonionic, anionic, cationic and zwitterionic surfactants having at least 4 carbon atoms, but preferably less than 200 carbon atoms or more preferably less than 90 carbon atoms as described below. Solvent compatible surfactants usually have a solvent-philic part that increases the solubility of the surfactant in the dry cleaning solvent/composition. Effective surfactants may comprise of one or more polar hydrophilic groups and one or more dry cleaning solvent-philic parts having at least 4 carbon atoms so that the surfactant is soluble in said dry cleaning solvent/composition. It is preferred that the surfactant is soluble in the dry cleaning composition, i.e., to at least the amount of surfactant used in the dry cleaning composition at 20° C. The composition may comprise one or a mixture of surfactants depending on the desired cleaning and garment care. One preferred surfactant is an anionic surfactant. Another preferred surfactant is a cationic surfactant. A particularly preferred surfactant is an acid surfactant having at least 4 carbon atoms.

The polar hydrophilic group, Z, can be nonionic, ionic (that is, anionic, cationic, or amphoteric), or a combination thereof. Typical nonionic moieties include polyoxyethylene and polyoxypropylene moieties. Typical anionic moieties include carboxylate, sulfonate, sulfate, or phosphate moieties. Typical cationic moieties include quaternary ammonium, protonated ammonium, imidazolines, amines, diamines, sulfonium, and phosphonium moieties. Typical amphoteric moieties include betaine, sulfobetaine, aminocarboxyl, amine oxide, and various other combinations of anionic and cationic moieties. Especially suitable surfactants comprise at least one polar hydrophilic group Z which is an anionic moiety whereby the counterion may be as described below.

The polar hydrophilic group Z is preferably selected from the group comprising $—SO_4M$, $—SO_3M$, $—PO_4M_2$, $—PO_3M_2$, $—CO_2M$ and mixtures thereof wherein each M can be independently selected from the group including H, $NR_4$, Na, K and Li, wherein each R is independently selected from H and $C_{1-4}$ alkyl radical but preferably H. When the surfactant is acid than preferably M is H but in some cases salts may also be used.

Fluorinated Surfactants

In one preferred embodiment, the surfactant is fluorinated or more preferably a fluorinated acid.

Suitable fluorosurfactants are in most cases those according to the formula (I):

$$(Xf)_n(Y)_m(Z)_p \quad (I)$$

and contain one, two or more fluorinated radicals Xf and one or more polar hydrophilic groups Z, which radicals and polar hydrophilic groups are usually (but not necessarily) connected together by one or more suitable linking groups Y. Preferably, n and p are integers independently selected from 1 to 4 and m is selected from 0 to 4. When the surfactant comprises more than one Xf, Y or Z group, then each of Xf, Y and Z may be the same or different. Preferably, the polar hydrophilic group is connected by a covalent bond to Y, or in absence of Y, to Xf.

The fluorinated radical, Xf, can generally be a linear or cyclic, saturated or unsaturated, aromatic or non-aromatic, radical preferably having at least 3 carbon atoms. The carbon chain may be linear or branched and may include hetero atoms such as oxygen or sulphur, but preferably not nitrogen. Preferably, Xf is an aliphatic and saturated. A fully fluorinated Xf radical is preferred, but hydrogen or chlorine may be present as substituents provided that not more than one atom of either is present for every two carbon atoms, and, preferably, the radical contains at least a terminal perfluoromethyl group. Radicals containing no more than about 20 carbon atoms are preferred because larger radicals usually represent a less efficient utilisation of fluorine.

Especially suitable Xf groups can be based on perfluorinated carbon: $C_nF_{2n+1}$ —wherein n is from 1–40, preferably 2 to 26, most preferably 2 to 18 or can be based on oligomers of hexafluoropropyleneoxide: $[CF(CF_3)—CF_2—O]_n$ wherein n is from 1 to 30. Suitable examples of the latter are marketed by E.I DuPont de Nemours and Co. under the name Krytox™ 157, especially, Krytox™ 157 FSL. Fluoroaliphatic radicals containing about 2 to 14 carbon atoms are more preferred.

The linking group, Y, is selected from groups such as alkyl, alkylene, alkylene oxide, arylene, carbonyl, ester, amide, ether oxygen, secondary or tertiary amine, sulfonamidoalkylene, carboxamidoalkylene, alkylenesulfonamidoalkylene, alkyleneoxyalkylene, or alkylenethioalkylene or mixtures thereof. In one preferred embodiment Y is $(CH_2)_t$ or $(CH_2)_tO$ wherein t is 1 to 10, preferably 1 to 6, most preferably 2 to 4. Alternatively, Y may be absent, in which case Xf and Z are directly connected by a covalent bond.

A particularly useful class of fluoroaliphatic surfactants useful in this invention are those wherein Xf, Y, and Z are as defined, and n is 1 or 2, m is 0 to 2, and p is 1 or 2.

Examples of very useful surfactants are those comprising at least wherein n is 1 to 4, m is 0 to 4, and p is 1 to 4, Z is as defined and $$Xf=R^1$$

$$Y=(R^2)_v$$

wherein $R^1$ is a perfluoroalkyl group having 1 to 40 carbon atoms; $R^2$ is an alkyl or an alkylene oxide group having 2 to 6 carbon atoms; and v is 0–10

Preferably, the surfactant is according to the formula $$[R^1—R^2_v]_wPO(OH)_{3-w}$$

wherein $R^1$ is a perfluoroalkyl group having 1 to 26 carbon atoms; $R^2$ is an alkyl or an alkylene oxide group having 2 to 6 carbon atoms; v is 0–10 and w is 1–2.

More preferably, $R^1$ is a perfluoroalkyl group having 2 to 16 carbon atoms; $R^2$ is an alkyl or an alkylene oxide group having 2 to 6 carbon atoms; v is 1 and w is 1 or 2.

Most preferably, $R^1$ is a perfluoroalkyl group having 2 to 14 carbon atoms; $R^2$ is ethylene oxide; v=1 and w=1–2.

Non-Fluorinated Surfactant

One other suitable class of surfactants are non-fluorinated surfactants according to the formula (II):

$$(Xh)_n(Y)_m(Z)_p \quad \text{(II)}$$

wherein Xh is a non-fluorinated radical and Y, Z, n, m and p are as described above for formula (I).

Xh may be a linear, branched or cyclic, saturated or unsaturated, aromatic or non-aromatic, radical preferably having at least 4 carbon atoms. Xh preferably includes hydrocarbon radicals. When Xh is a hydrocarbon, the carbon chain may be linear, branched or cyclic and may include hetero atoms such as oxygen, nitrogen or sulphur, although in some cases nitrogen is not preferred. Preferably, Xh is aliphatic and saturated. Radicals containing no more than about 24 carbon atoms are preferred. Examples of suitable non-fluorinated anionic surfactants include Crodafos™ 810A (ex Croda).

Other classes of suitable surfactants include, but are not limited to:

a) Polyethylene oxide condensates of nonyl phenol and myristyl alcohol, such as in U.S. Pat. No. 4,685,930 Kasprzak; and b) fatty alcohol ethoxylates, $R—(OCH_2CH_2)_aOH$ wherein a=1 to 100, typically 1 to 30, R=hydrocarbon residue 8 to 20 C atoms, typically linear alkyl. Examples polyoxyethylene lauryl ether, with 4 or 10 oxyethylene groups; polyoxyethylene cetyl ether with 2, 6 or 10 oxyethylene groups; polyoxyethylene stearyl ether, with 2, 5, 15, 20, 25 or 100 oxyethylene groups; polyoxyethylene (2), (10) oleyl ether, with 2 or 10 oxyethylene groups. Commercially available examples include, but are not limited to: BRIJ and NEODOL. See also U.S. Pat. No. 6,013,683 Hill et al. Other suitable nonionic surfactants include Tween™.

Suitable cationic surfactants include, but are not limited to dialkyldimethyl amonium salts having the formula: $R'R''N^+(CH_3)_2X^-$ wherein R' and R" are each independently selected from the group consisting of 1–30 C atoms or derived from tallow, coconut oil or soy, X=Cl, I or Br, Examples include: didodecyldimethyl ammonium bromide (DDAB), dihexadecyldimethyl ammonium chloride, dihexadecyldimethyl ammonium bromide, dioctadecyldimethyl ammonium chloride, dieicosyldimethyl ammonium chloride, didocosyldimethyl ammonium chloride, dicoconutdimethyl ammonium chloride, ditallowdimethyl ammonium bromide (DTAB). Commercially available examples include, but are not limited to: ADOGEN, ARQUAD, TOMAH, VARIQUAT. See also U.S. Pat. No. 6,013,683 Hill et al.

Also suitable surfactants are silicone surfactants including, but not limited to the polyalkyleneoxide polydimethylsiloxanes having a polydimethylsiloxane hydrophobic moiety and one or more hydrophilic polyalkyleneoxide side chains and have the general formula:

$$R^1—(CH_3)_2SiO—[(CH_3)_2SiO]_a—[(CH_3)(R^1)SiO]_b—Si(CH_3)_2—R^1$$

wherein a+b are from about 1 to about 50, preferably from about 3 to about 30, more preferably from about 10 to about 25, and each $R^1$ is the same or different and is selected from the group consisting of methyl and a poly(ethyleneoxide/propyleneoxide) copolymer group having the general formula:

$$—(CH_2)_nO(C_2H_4O)_c(C_3H_6O)_dR^2$$

with at least one $R^1$ being a poly(ethyleneoxide/propyleneoxide) copolymer group, and wherein n is 3 or 4, preferably 3; total c (for all polyalkyleneoxide side groups) has a value of from 1 to about 100, preferably from about 6 to about 100; total d is from 0 to about 14, preferably from 0 to about 3; and more preferably d is 0; c+d has a value of from about 5 to about 150, preferably from about 9 to about 100 and each $R^2$ is the same or different and is selected from the group consisting of hydrogen, an alkyl having 1 to 4 carbon atoms, and an acetyl group, preferably hydrogen and methyl group. Examples of these surfactants may be found in U.S. Pat. No. 5,705,562 and U.S. Pat. No. 5,707,613, both of which are incorporated herein by reference.

Examples of this type of surfactants are the Silwet™ surfactants which are available from CK Witco, OSi Division, Danbury, Conn. Representative Silwet™ surfactants are for example L-7608, L-7607, L-77, L-7605, L-7604, L-7600, L-7657, L-7602. The molecular weight of the polyalkyleneoxide group ($R^1$) is less than or equal to about 10,000. Preferably, the molecular weight of the polyalkyleneoxide group is less than or equal to about 8,000, and most preferably ranges from about 300 to about 5,000. Thus, the values of c and d can be those numbers which provide molecular weights within these ranges. However, the number of ethyleneoxide units ($—C_2H_4O$) in the polyether chain ($R^1$) must be sufficient to render the polyalkyleneoxide polysiloxane water dispersible or water soluble. If propyleneoxide groups are present in the polyalkyleneoxide chain, they can be distributed randomly in the chain or exist as blocks. Especially preferred Silwet™ surfactants are L-7600, L-7602, L-7604, L-7605, L-7657, and mixtures thereof. Besides cleaning and/or emulsifying activity, polyalkyleneoxide polydimethylsiloxane surfactants can also provide other benefits, such as anti-static benefits, and softness to fabrics.

The preparation of polyalkyleneoxide polydimetylsiloxanes is well known in the art. Polyalkyleneoxide polydimethylsiloxanes of the present invention can be prepared according to the procedure set forth in U.S. Pat. No. 3,299,112, incorporated herein by reference.

Another suitable silicone surfactant is SF-1488, which is available from GE silicone fluids. Especially preferred silicone surfactants include Tegopren™ 7008 and 7009 (ex Goldschmidt).

These and other surfactants suitable for use in combination with the organic dry cleaning solvent as adjuncts are well known in the art, being described in more detail in Kirk Othmer's Encyclopaedia of Chemical Technology, 3rd Ed., Vol. 22, pp. 360–379, "Surfactants and Detersive Systems", incorporated by reference herein. Further suitable nonionic detergent surfactants are generally disclosed in U.S. Pat. No. 3,929,678, Laughlin et al., issued Dec. 30, 1975, at column 13, line 14 through column 16, line 6, incorporated herein by reference. Other suitable detergent surfactants are generally disclosed in WO-A-0246517.

The surfactant or mixture of surfactants is present in an effective amount. An effective amount is the amount needed for the desired cleaning. This will, for example, depend on the number of articles, level of soiling and volume of dry cleaning composition used. However, surprisingly effective cleaning was observed when the surfactant was present from at least 0.001 wt. % up to and including 10 wt. % by weight of the dry cleaning composition. More preferably, the surfactant is present from 0.01 up to and including 3 wt. % or even more preferably from 0.05 up to and including 0.9 wt. % by weight of the dry cleaning composition.

Optional Cleaning Agents

The dry cleaning compositions may contain one or more optional cleaning agents. Cleaning agents are mainly added to dry cleaning compositions to facilitate the cleaning of hydrophilic composite stains or in some cases of oily or particulate stains. In other cases cleaning agents may be added for enhanced garment care.

Useful cleaning agents are those which can form a homogeneous solution with the dry cleaning solvent and optionally a cosolvent as defined above. These can be easily selected by one of ordinary skill in the art from the numerous known detergents used in the detergents industry. Examples include enzymes organic and inorganic bleaches, ozone, or other cleaning means like ultraviolet light and radiation.

The amount of cleaning agents present in the compositions of the invention is only limited by the compatibility of the cleaning agents. Any desired amount of a cleaning agent may be used preferably provided that the resulting dry cleaning composition is homogeneous as defined above. An effective amount of a cleaning agent is that amount which is compatible with or soluble in either the dispersed or continuous phase. Usually the solvent will be the continuous phase. Generally, the cleaning agent may be present in the compositions of the invention in an amount of about 0 to 20 wt. %, preferably 0 to 10 wt. %, more preferably 0 to 2 wt. %, still more preferably an amount of about 2 wt. % or less.

The dry cleaning compositions may also optionally contain other additives that would alter the physical properties of the fabric in a desired way, after the cleaning process. These would include materials that would increase the softness of the fabric, repellency, etc. Generally, the cleaning compositions of the invention can be made by simply mixing the components together to form either a solution, a macro-emulsion or a micro-emulsion.

Some suitable cleaning agents and additives include, but are not limited to, builders, enzymes, bleach activators, bleach catalysts, bleach boosters, bleaches, alkalinity sources, antibacterial agents, colorants, perfumes, pro-perfumes, finishing aids, lime soap dispersants, composition malodour control agents, odour neutralisers, polymeric dye transfer inhibiting agents, crystal growth inhibitors, photobleaches, heavy metal ion sequestrants, anti-tarnishing agents, anti-microbial agents, anti-oxidants, anti-redeposition agents, soil release polymers, electrolytes, pH modifiers, thickeners, abrasives, divalent or trivalent ions, metal ion salts, enzyme stabilisers, corrosion inhibitors, diamines or polyamines and/or their alkoxylates, suds stabilising polymers, process aids, fabric softening agents, optical brighteners, hydrotropes, suds or foam suppressors, suds or foam boosters, fabric softeners, anti-static agents, dye fixatives, dye abrasion inhibitors, anti-crocking agents, wrinkle reduction agents, wrinkle resistance agents, soil repellency agents, sunscreen agents, anti-fade agents, and mixtures thereof.

The invention is more fully illustrated by the following non-limiting examples showing some preferred embodiments of the invention.

EXAMPLES

Example 1

Pieces of woven cotton (1 gr) dyed with various dyes (see table I) were first immersed with non-aqueous dry cleaning composition A and agitated for 30 min at 20° C., followed by a 5 min rinse in fresh solvent. Thereafter, the cloths were immersed in regeneration composition B and finally rinsed for 5 min with clean solvent (see table II). The liquid to cloth ratio (LCR) was 13 (w/w). The reflectance before and after each step is monitored on an X-rite 968 colorimeter.

TABLE I

| Dye classes used |
|---|
| Direct dye |
| Copper phthalocyanine based |
| reactive |
| Acid dye |

TABLE II

| Composition | | A (wt. %) | B (wt. %) |
|---|---|---|---|
| Surfactant | Zonyl ™ UR | 2.0 | 0.5 |
| Water | $H_2O$ | 0 | — |
| phase | carbonate buffer | — | 10 |
| Solvent | Balance | HFE-7100 ™ | HFE-7100 ™ |

Zonyl™ UR fluorosurfactant is available from E.I DuPont de Nemours and Co. Nonafluoromethoxybutane is marketed under the name HFE-7100™ by the 3M Company.

Colour damage was observed after dry cleaning with composition A. But after a subsequent regeneration step with composition B, colour care was visibly improved. The water phase of composition B was 1:1 50 mmol/L sodium hydrogen carbonate/sodium carbonate buffer with a pH of 10.01.

Example 2

Example 1 was repeated with the exception that instead of composition B, regeneration compositions C was used (see table III).

TABLE III

| Composition | | C (wt. %) |
|---|---|---|
| Surfactant | | 0.76% AOT<br>1% Plurafac ™ LF 403 |
| Water phase | carbonate buffer | 10% |
| Solvent | Balance | DF2000 ™ |

DF2000™ is hydrocarbon dry cleaning solvent available from Exxon Mobil corporation. AOT is Na bis(2-ethylhexyl) sulfosuccinate and Plurafac™ is a nonionic fatty alcohol alkoxylate available from BASF corporation. The water phase of composition C was 1:1 50 mmol/L sodium hydrogen carbonate/sodium carbonate buffer with a pH of 10.01. Composition C according to the invention was effective in regenerating the colour of the cloths, whereby the regeneration was more effective and rapid compared to the effects of composition B. Regeneration occurred within 10 s or at least within 5 to 15 min.

Example 3

Cloths were dry cleaned with composition A as in Example 1.

The colour damaged cloths were successfully regenerated with compositions wherein the water phase A) Soda ash (5 g/L), pH 11

B) Disodium hydrogen phosphate (27.5 mmol/L) and Potassium dihydrogen phosphate (20.0 mmol/L), pH 7

C) Sodium tetraborate (10 mmol/L), pH 9.18

Example 4

The following regeneration compositions were used wherein the water phase comprised one of the following bases or buffers:

A) 50 ml 0.1 molar potassium dihydrogen phosphate, pH 6.04

B) 50 mmol Potassium hydrogen phthalate, pH 4 Composition B could only partly regenerate the colour damage whereas composition A was effective as a regeneration composition.

What is claimed is:

1. A process for dry cleaning laundry articles comprising at least one dry cleaning step followed by at least one regeneration step wherein said regeneration step comprises contacting the articles with a regeneration composition comprising 0 to 10 wt. % of a surfactant;

0.001 to 10 wt. % of water;

0 to 50 wt. % of a cosolvent and the balance being a non-flammable, non-chlorine containing organic dry cleaning solvent selected from the group consisting of hydrofluorocarbons, hydroflouroethers, or mixtures thereof, wherein the regeneration composition comprises an aqueous phase having a pH of at least 5.

2. A process for dry cleaning laundry articles according to claim 1 wherein the regeneration composition comprises 0 to 80 wt. % of an inorganic or organic base and/or acid by weight of the aqueous phase.

3. A process for dry cleaning laundry articles according to claim 2 wherein at least one base and/or acid is selected from compounds comprising at least one hydroxide, amine, carboxylate, carbonate, citrate, borate, phosphate group and mixtures thereof.

4. A process for dry cleaning laundry articles according to claim 1 wherein the dry cleaning step comprises contacting the laundry articles with a dry cleaning composition comprising said composition comprising an effective amount of surfactant; 0 to 50 wt. % of a cosolvent and the balance being a non-flammable, non-chlorine containing organic dry cleaning solvent.

5. A process for dry cleaning laundry articles according to claim 4 wherein the dry cleaning composition is a low aqueous dry cleaning composition comprising 0.001 to 10 wt. % of a surfactant;

0.01 to 10 wt. % of water;

0 to 50 wt. % of a cosolvent and the balance being a non-flammable, non-chlorine containing organic dry cleaning solvent.

6. A process for dry cleaning laundry articles according to claim 5 wherein the surfactant is a fluorinated acid.

7. A process for dry cleaning laundry articles according to claim 1 wherein the organic dry cleaning solvent is selected from the group consisting of the isomers of nonafluoromethoxybutane, nonafluoroethoxybutane and decafluoropentane and mixtures thereof.

8. A process for dry cleaning laundry articles according to claim 1 wherein the composition comprises a cosolvent in an amount from 1 to 50 wt. %.

9. A process for dry cleaning laundry articles according to claim 8 wherein the cosolvent is selected from the group consisting of alcohols, ethers, glycol ethers, alkanes, alkenes, linear and cyclic amides, perfluorinated tertiary amines, perfluoroethers, cycloalkanes, esters, ketones, aromatics, siloxanes and mixtures thereof.

10. A process for dry cleaning laundry articles according to claim 9 wherein the siloxane is $$R_3—Si(—O—SiR_2)_w—R$$

where each R is independently chosen from an alkyl group having from 1 to 10 carbon atoms and w is an integer from 1 to 30.

11. A process for dry cleaning laundry articles according to claim 5 wherein the low aqueous dry cleaning composition comprises a) an organic dry cleaning solvent selected from the group comprising isomers of nonafluoromethoxybutane, nonafluoroethoxybutane and decafluoropentane and mixtures thereof;

b) 0.01 to 0.9 wt. % water and c) 0.001 to 10 wt. % at least one surfactant wherein the surfactant is according to the formula $$[R^1—R^2_v]_wPO(OH)_{3-w}$$

wherein $R^1$ is a perfluoroalkyl group having 2 to 14 carbon atoms; $R^2$ is ethylene oxide; v=1 and w=1–2.

12. A process for dry cleaning laundry articles according to claim 5 wherein the process of dry cleaning comprises at least one non-aqueous dry cleaning step prior to the low aqueous dry cleaning step, wherein said articles are contacted with a non-aqueous dry cleaning composition said non-aqueous dry cleaning composition comprising 0.001 to 10 wt. % of a surfactant;

0 to 0.1 wt. % of water;

0 to 50 wt. % of a cosolvent and the balance being a non-flammable, non-chlorine containing organic dry cleaning solvent selected from the group consisting of hydroflourocabons, hydrofluoethers, or mixtures thereof.

13. A process for dry cleaning laundry articles according to claim 4 wherein the dry cleaning composition is a non-aqueous dry cleaning composition said non-aqueous dry cleaning composition comprising 0.001 to 10 wt. % of a surfactant;

0 to 0.1 wt. % of water;

0 to 50 wt. % of a cosolvent and the balance being a non-flammable, non-chlorine containing organic dry cleaning solvent selected from the group consisting of hydroflourocabons, hydrofluoethers, or mixtures thereof.

14. A process for dry cleaning laundry articles according to claim 4 wherein the dry cleaning composition further comprises a cleaning agent.

15. A process for dry cleaning laundry articles according to claim 14 wherein the dry cleaning composition comprises less than 2 wt. % of the cleaning agent and said cleaning agent is selected from the group consisting of enzymes, organic and inorganic bleaches.

16. A process for dry cleaning laundry articles according to claim 4 wherein the surfactant is an anionic surfactant.

17. A process for dry cleaning laundry articles according to claim 16 wherein the surfactant comprises at least one polar hydrophilic group selected from —$SO_4M$, —$SO_3M$, —$PO_4M_2$, —$PO_3M_2$, —$CO_2M$ and mixtures thereof wherein each M can be independently selected from the group including H, $NR_4$, Na, K and Li, wherein each R is independently selected from H and $C_{1-4}$ alkyl radical.

18. A process for dry cleaning laundry articles according to claim 17 wherein M is H.

19. A process for dry cleaning laundry articles according to claim 4 wherein the dry cleaning composition is a low aqueous dry cleaning composition comprising 0.01 to 0.9 wt. % of water;

and the surfactant comprises at least one anionic headgroup.

20. A process for dry cleaning laundry articles according to claim 12 wherein the non-aqueous dry cleaning composition comprises 0.05 to 0.9 wt. % of a surfactant wherein said surfactant comprises at least one anionic headgroup.

* * * * *